US006823997B2

(12) United States Patent
Lindén et al.

(10) Patent No.: US 6,823,997 B2
(45) Date of Patent: Nov. 30, 2004

(54) ARRANGEMENT IN A SUPPORTING DEVICE FOR GOODS

(75) Inventors: Henrik Lindén, Sundsvall (SE); Börje Josefsson, Sundsvall (SE)

(73) Assignee: HL Display AB, Skarpnack (SE)

( * ) Notice: Subject to any disclaimer, the term of this patent is extended or adjusted under 35 U.S.C. 154(b) by 0 days.

(21) Appl. No.: 10/332,078

(22) PCT Filed: Jul. 2, 2001

(86) PCT No.: PCT/SE01/01522

§ 371 (c)(1),
(2), (4) Date: Jan. 2, 2003

(87) PCT Pub. No.: WO02/03836

PCT Pub. Date: Jan. 17, 2002

(65) Prior Publication Data

US 2003/0150829 A1 Aug. 14, 2003

(30) Foreign Application Priority Data

Jul. 7, 2000 (SE) ..... 0002579

(51) Int. Cl.[7] ..... A47F 7/00
(52) U.S. Cl. ..... 211/59.3; 211/175
(58) Field of Search ..... 211/175, 74, 184, 211/43, 59.3, 126.1, 59.4, 51; 248/354.7, 292.12; 312/35, 42, 71, 97

(56) References Cited

U.S. PATENT DOCUMENTS 1,335,446 A * 3/1920 McDaniel ..... 248/292.12
1,338,066 A * 4/1920 Blocker ..... 294/166
1,750,576 A * 3/1930 Cubberley ..... 211/11
1,992,186 A * 2/1935 Evans ..... 211/51
3,487,945 A * 1/1970 Barham ..... 211/43
3,844,415 A * 10/1974 Heimann ..... 211/43
4,343,450 A * 8/1982 Anderson ..... 248/454
4,458,874 A * 7/1984 Rabas et al. ..... 248/670
4,496,127 A * 1/1985 Nelson ..... 248/441.1
4,897,958 A * 2/1990 Brydges ..... 47/68
5,413,229 A * 5/1995 Zuberbuhler et al. ..... 211/59.3
6,227,513 B1 * 5/2001 Richard ..... 248/346.07
6,446,802 B1 * 9/2002 Lutz et al. ..... 206/354

FOREIGN PATENT DOCUMENTS

DD 3211880 A1 10/1983
DE 9210275 U1 11/1992
WO WO 00/48488 A 8/2000

* cited by examiner

*Primary Examiner*—Carl D. Friedman
*Assistant Examiner*—Jennifer E. Novosad
(74) *Attorney, Agent, or Firm*—Sughrue Mion, PLLC

(57) ABSTRACT

A device for use with a support for goods which are to stand in rows on the shelves of a shop or store-room, in particular such goods as are arranged in compartments formed by transverse dividers. The support includes a track (6) provided with sawtooth racks (8) and a support device (7) that can be moved along the track, with a bottom plate (13), a support back (15) projecting upward from the bottom plate, and backward-projecting locking elements (16) which interact with the sawtooth rack (8) in the track. The device includes an operating tool (10) arranged under the bottom plate (13) of the support device (7) in such a way that it can be pulled out. The operating tool is designed with lugs projecting upward from it arranged to interact with the bottom plate (13) of the support device when the operating tool (10) is pulled out, in order to bring the support device forward by means of a forward movement of the operating tool, for moving forward goods which are supported by the support device.

11 Claims, 5 Drawing Sheets

15
7
13
8
10
6
17
8
14
16
11
12

15
16
13
7
14
18
16
17
14

ARRANGEMENT IN A SUPPORTING DEVICE FOR GOODS

TECHNICAL FIELD

The present invention relates to a device for use with a support for goods which are to stand in rows on the shelves of a shop or store-room, in particular such goods as are arranged in compartments formed by transverse dividers, which support comprises a track provided with sawtooth racks and a support device that can be moved along the track, which support device has a bottom plate and a support back projecting upward from the bottom plate.

BACKGROUND TO THE INVENTION

Supports of this kind are used, for example, for supporting products packed in sachets, small boxes or packages. In order to make it easy for the consumer to take hold of the first package in a row, the row of packages should be kept to the front edge of the shelf. This requires among other things the row of packages to be supported by a support back which can easily be moved in the appropriate compartment. The support is moved forward as the goods are removed, but must then be able to be returned to a position toward the back of the shelf for replenishing goods in the compartment.

Known support devices are available for this purpose, comprising a track provided with a sawtooth rack which is arranged in the compartment and interacts with a support device that can be moved along the track, which support device has projections engaging with the sawtooth rack on the track and a support back projecting upward from the bottom plate. A problem with certain known devices of this kind has been that the support device can be moved backward in the compartment unintentionally by the application of a force to the vertical support back.

In order to eliminate this problem, devices have previously been proposed in which the risk of such unintentional movement is eliminated. This has, however, meant that the devices have become more complicated to use, as an intentional movement of the support device has also been made more difficult. In some embodiments, such a movement requires the whole support device to be pivoted forward before it can be moved. This means, however, that products standing on the support device must also be tipped forward.

Another device utilizes a spring element which engages with the sawtooth rack on the track. The engagement of the spring element with the track must be released manually to permit an intentional movement of the support device. As the spring element is located at the back of the support device, there must be room to reach beside or above the support device, which is not always the case. Our international patent application PCT/SE00/00324 describes a support of the type described above, in which the risk of unintentional movement of the support in a backward direction has been eliminated, while at the same time a required movement can be carried out in a very simple way.

The previous support is of the type described in the first paragraph and is characterized in that the support device is provided with backward-projecting elements which engage and lock with the sawtooth racks on the track when a backward force is applied to the support back and in that the said locking elements are arranged to be lifted up out of engagement with the said sawtooth racks when a backward force is applied to a front part of the bottom plate of the support device, which force causes the bottom plate to pivot upward around a transverse axis at its front end as a result of the interaction between the bottom plate and the sawtooth racks on the said track, raising the back part and the said locking elements.

This device thus effectively prevents an unintentional movement of the support device backward as a result of a force on the support back and at the same time makes it easy to move it intentionally by the application of a force to the bottom plate of the support device, which force brings about a small pivoting movement of the support device and also the required backward movement.

The support device described above can easily be moved forward by applying a force on the rear of the support back by hand. In many cases, this can be difficult to carry out, as there can be no room to reach behind the support device due to the positions of the shelf above and the side dividers.

In the device described above, this is solved by an elongated operating tool being able to be inserted under the bottom plate of the support device from the front end of the track, which tool lifts the device thereby releasing the engagement of the said locking elements with the sawtooth racks on the track and also the engagement between the projections on the bottom plate and the said sawtooth racks, after which the support device can be moved forward or backward using the said operating tool.

By using an elongated operating tool in this way, the support device can be operated from the front of the compartment without needing to reach the back of the vertical support back. This is a great advantage when the compartments are narrow and when there is only a small distance between the shelf and the one above.

The device described above is thus based on the person who is going to operate the support for goods carries a tool of the type described above, which tool is temporarily inserted into the compartment where the support back is to be moved. It cannot, however, be left in place, as it would then protrude out from the shelf.

OBJECTS OF THE INVENTION

The main object of the present invention is to obtain a device for moving supports for goods as described above, which can be permanently inserted in a compartment for goods, so that it is always in place when the support for goods and the goods supported by this are to be pulled forward toward the front of the respective compartment.

This is obtained according to the present invention by means of a device of the kind defined in the first paragraph, which is characterized in that the track provided with sawtooth racks is stationary, in that the bottom plate of the support device forms a supporting surface for goods and is arranged to be guided by the said tracks when it is moved, and in that to bring about movement toward the front edge of a shelf it is moved relative to the teeth on the track, in that the device further comprises an elongated operating tool of essentially the same length as the said track, arranged under the bottom plate of the support device and in a recess in the track provided with sawtooth racks in such a way that it can be pulled out, and in that the operating tool is designed with means projecting upward from it and designed to interact with the said bottom plate of the support device when the operating tool is pulled out in order to bring this forward by means of a forward movement of the operating tool.

This operating tool can thus always remain in place and is simple to use and can be so designed that it automatically raises up the bottom plate, along with the goods standing on the bottom plate, when it is pulled forward. When the movement of the support device has been completed, the operating tool can be pushed right back into the compartment, whereupon the support device returns to the initial position with the locking elements engaging with the sawtooth racks on the track.

The operating tool is preferably designed with two projecting lugs, one of which is arranged to interact with a rear part of the bottom plate, while the other is arranged to interact with a part projecting downward from the front part of the bottom plate. One of these lugs is thereby arranged so that it also acts as a dog means.

In a preferred embodiment, the distance between these lugs is the same as the distance between the front and back parts of the bottom plate, which means that a simultaneous raising of the whole bottom plate is achieved when the operating tool is pulled forward.

Further characteristics of the invention will be apparent from the patent claims.

The invention will be described in greater detail below, utilizing examples of preferred embodiments and with reference to the attached figures.

DETAILED DESCRIPTION OF A PREFERRED EMBODIMENT

Figures 1, 2:
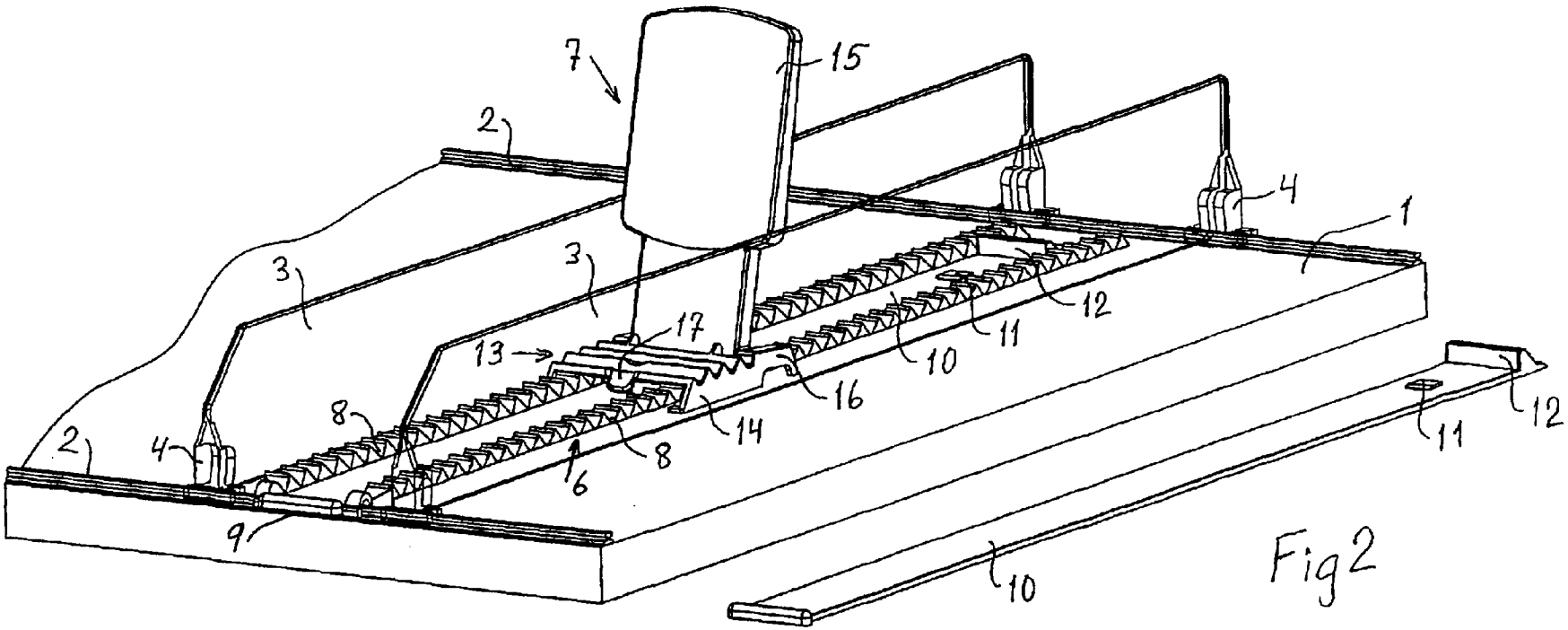
FIG. 1 shows part of a shop shelf with a support according to the present invention.
FIG. 2 shows an operating tool according to the present invention for use together with the support as claimed in FIG. 1.

FIG. 1 shows a part 1 of a shop shelf with fixing strips 2 running along the front and back edges of the shelf. Dividers 3 with essentially U-shaped fixing heads 4 are snapped onto the fixing strips 2, so that these dividers can be moved along the shelf to form compartments of the required width. In the figure only one compartment is shown.

At the bottom of the compartment, there is a track 6 for a support device 7. The ends of this track can also be snapped onto the fixing strips 2.

The track 6 has two side portions provided with transverse sawtooth racks 8. Between these portions there is a recess 9. The sawtooth racks 8 comprise essentially V-shaped troughs with crests between.

FIG. 2 shows an elongated operating tool 10 with two projecting lugs 11, 12 on the rear part. The operating tool 10 is relatively thin and is designed to be inserted into the recess 9 in the support track 6 in such a way that it can be moved, so that it extends underneath the support device 7.

Figure 3:
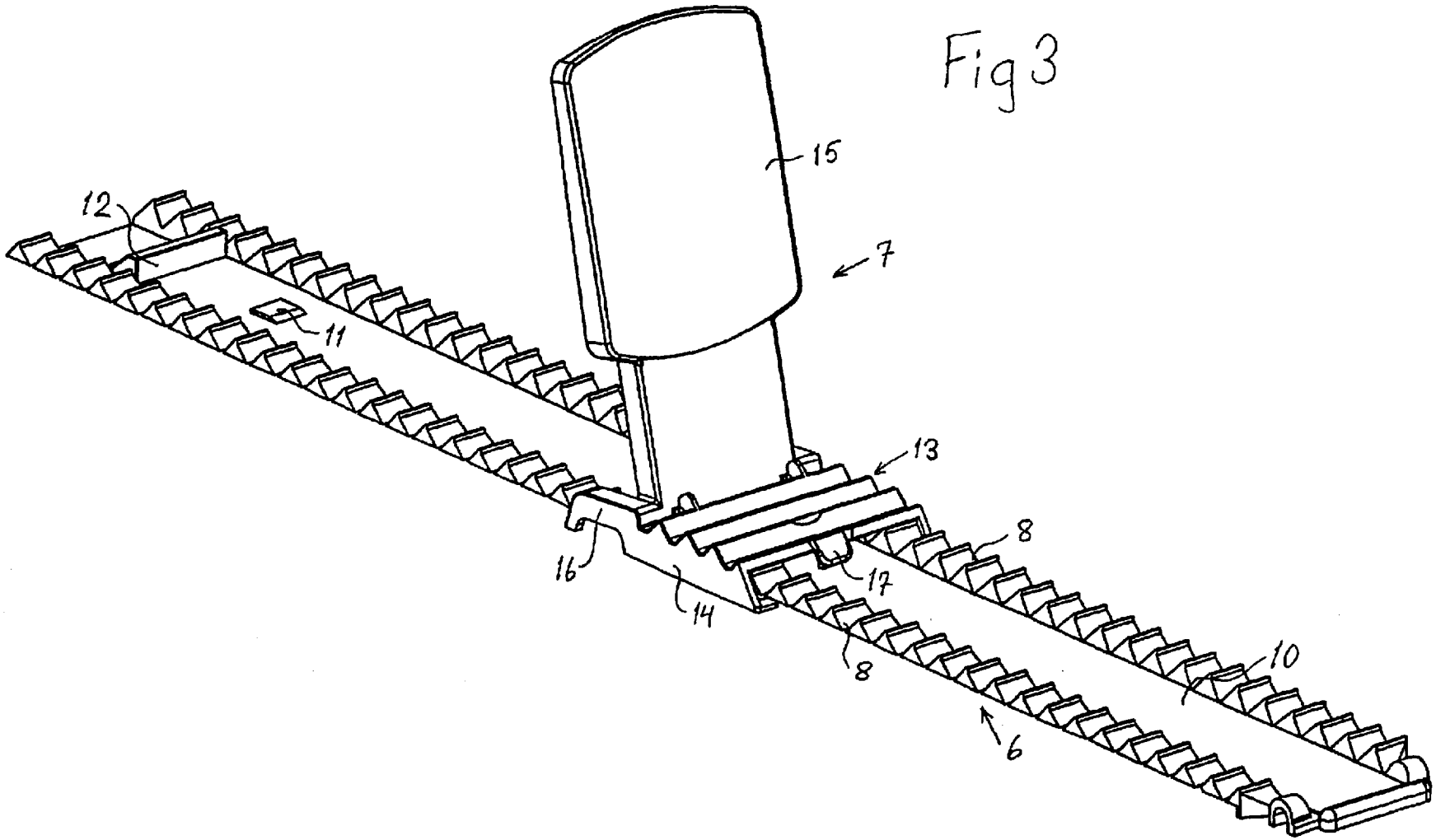
FIG. 3 shows a support according to the present invention with the operating tool installed.
Figure 4:
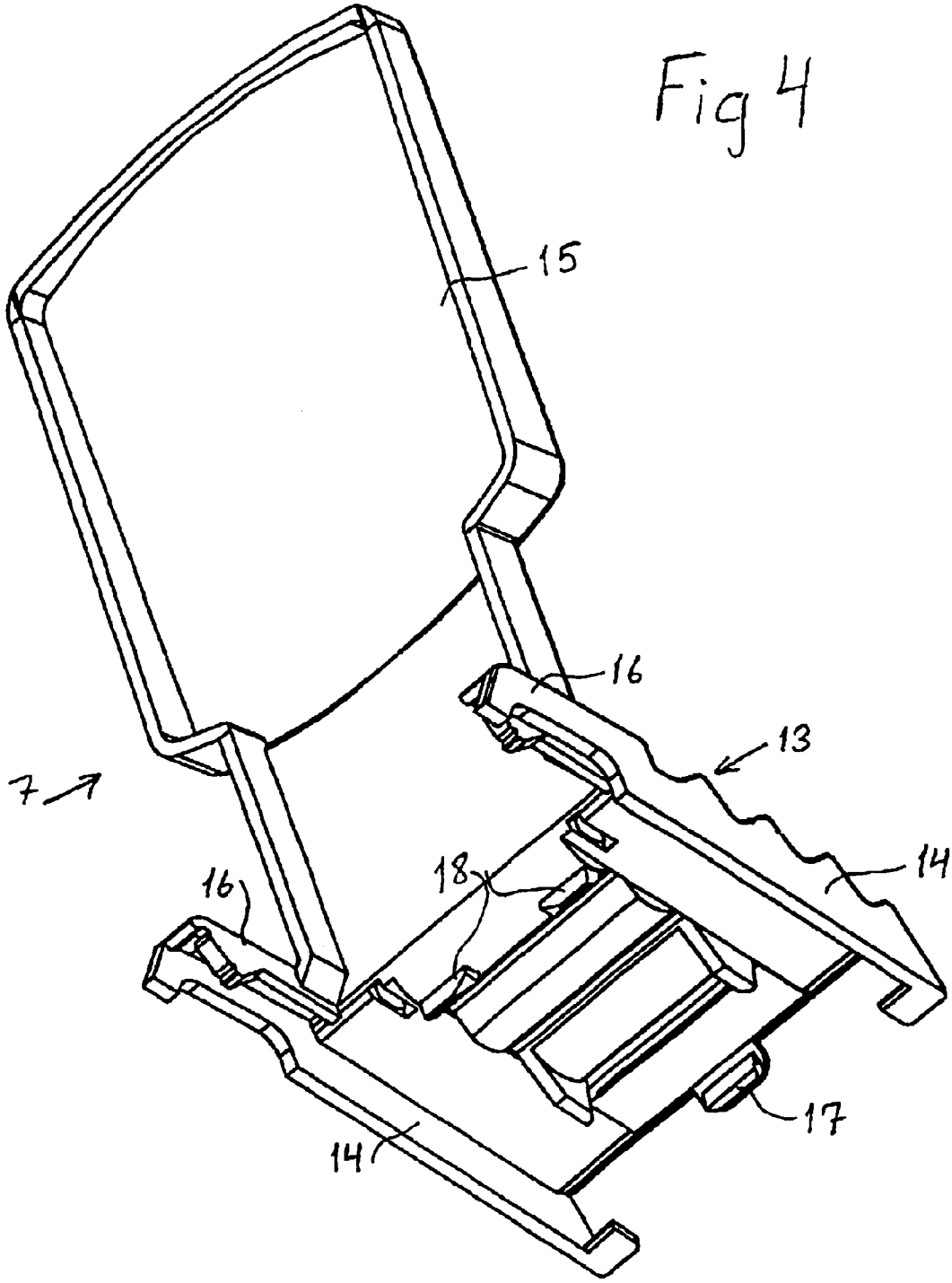
FIG. 4 shows a support device incorporated in the support shown in FIG. 3 viewed obliquely from below.

FIG. 3 shows the track 6 with the support device 7 and installed operating tool 10. The support device 7 which can be moved along the track 6, see also FIG. 4, comprises a bottom plate 13 with essentially V-shaped recesses on its upper side, in which products (not shown) can be stood.

The bottom plate 13 is provided with side flanges 14, which project downward, which guide the bottom plate along the edges of the track 6. At least the front parts of these flanges encloses the edges of the track 6 to hold the support device 7 on the track. There is, however, a certain amount of play between the track and the flanges which enclose it, allowing the support device to be raised slightly relative to the track.

The bottom plate 13 is provided with a support back 15 which projects upward. The support back 15 is intended to act as a support for a row of standing products, for example sachets, which are supported on the bottom plate 13 and on the parts of the edges of the track 6 in front of this. As packets are taken from the shelf, the support device 7 with the support back 15 can be moved forward, so that front part of the compartment is always kept full of packets.

In order to prevent an unintentional movement of the support device 7 in the opposite direction, that is toward the back of the shelf, the bottom plate 13 of the support device 7 is provided with two backward-projecting arms 16, which are arranged to interact with the transverse toothed rack 8 of the track 6. A backward force on the support back 15 will thus not be able to bring about an unintentional movement of the support device backward. An intentional movement of the support device in a backward direction can, however, be achieved by means of a force applied on the part 17 protruding downward from the front part of the bottom plate 13. Such a force will namely bring about a pivoting movement upward of the back part of the bottom plate 13 which is provided with the locking arms 16, so that the engagement between these and the sawtooth rack 8 of the track 6 is released. This is described in greater detail in our international patent application PCT/SE00/00324 mentioned above, and will not be described in greater detail in the present application.

In many cases, the distance between a shelf and the shelf above it and the distance between the support back 15 and the adjacent dividers 3 can be so small that it is not possible to reach behind the support back 15 in order to pull the support device 7 forward toward the front edge of the shelf. This problem is solved in accordance with the present invention by means of the elongated operating tool 10, which is inserted underneath the bottom plate 13 of the support device 7 in the recess 9 between the edges of the track 6.

The back part of the operating tool 10 is provided with two projecting lugs 11, 12 at a distance apart which essentially corresponds to the distance between the front and back parts of the bottom plate. The function of these is as follows. When the support device 7 is to be moved forward in a compartment, from for example the position shown in FIG. 5, the operating tool 10 is pulled outward. The projecting lug 11, which has suitably a wedge-shaped front surface, thereby fits under the bottom plate 13 of the support device and engages with the downward-projecting part 17 of the bottom plate. At the same time, the back lug 12 engages with the lower part of the support back 15, which is suitably rounded off. As a result, the support device 7 with the bottom plate 13 and the support back 15 will be raised upward relative to the track 6, see FIG. 6. The rear transverse lug 12 thereby also acts as a dog means, which engages with a downward-projecting lug 18 on the underside of the bottom plate 13. The whole support device 7 can thereby be pulled forward toward the front of the shelf by pulling out the operating tool 10.

Figure 5:
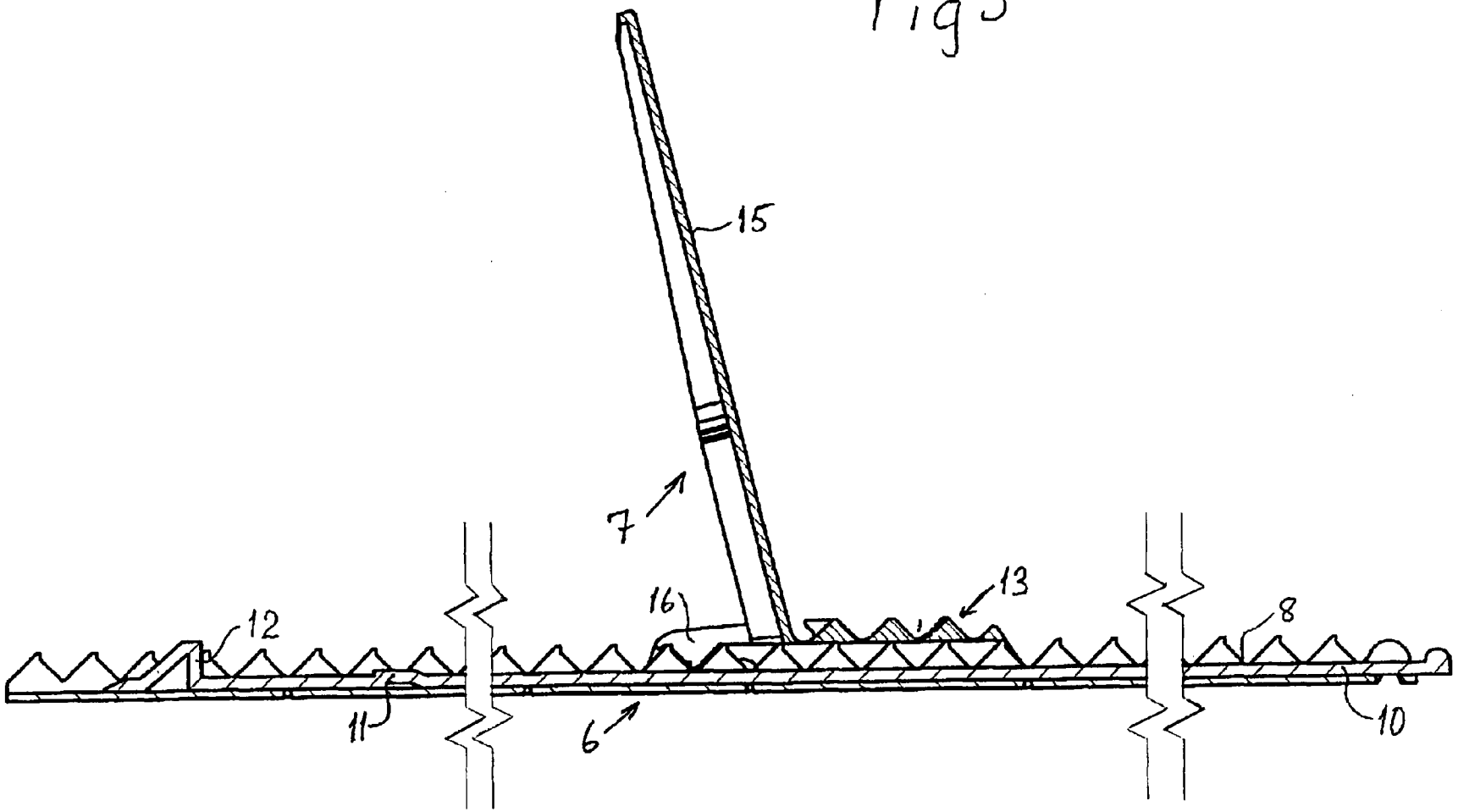
FIG. 5 is a longitudinal section through a device as shown in FIG. 3.
Figure 6:
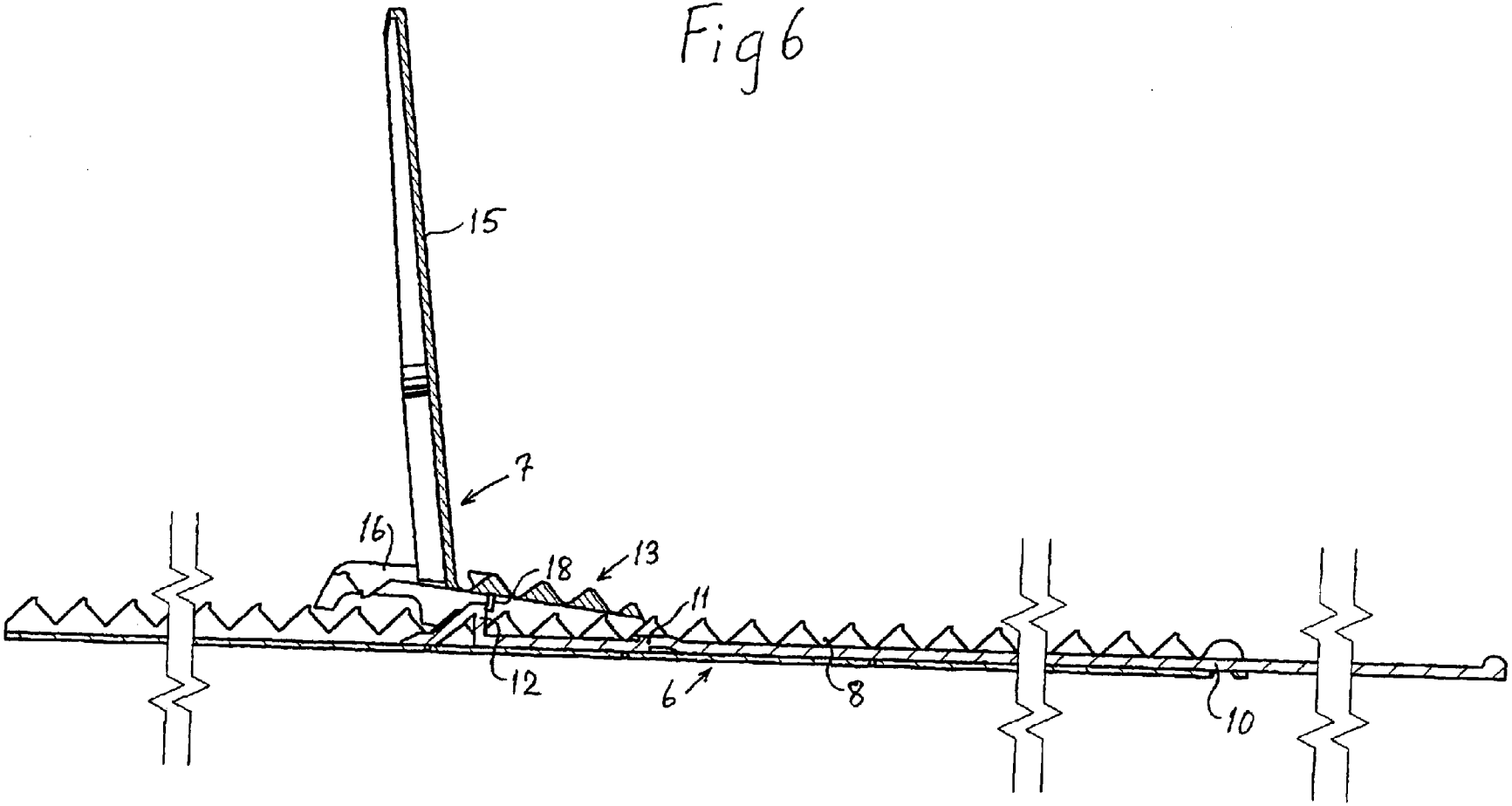
FIG. 6 is a longitudinal section corresponding to FIG. 5, where the support device is in a raised position.

When the required position has been reached, the operating tool 10 can be pushed back in the recess 9, to the position shown in FIG. 5, whereupon the support device is lowered back, so that the locking arms 16 re-engage and lock with the sawtooth edges of the track 6. The operating tool 10 can suitably be pushed right in to the track so that no part of the operating tool projects from the front edge of the shelf. The operating tool is thereby ready for further pulling forward of the support device 7 when this is required.

The arrangement described is very advantageous, as the person responsible for the display of products in the shop does not need to bring any special tool for moving the support devices in the different compartments, but instead can carry this out in a simple way using an operating tool already located in the respective compartment.

The invention has been described above in connection with the preferred embodiment shown in the figures. This can, however, be varied in several respects within the framework of the patent claims. Thus, for example, the precise shape of the sawtooth rack on the edges of the track 6 and the locking arms of the support device 7 can be varied. This also applies to the design of the operating tool and in particular to the number and shape of the projecting lugs 11 and 12 and the design of the interacting parts of the support device 7.

What is claimed is:

1. A support system for goods which are to stand in a row on a shelf, said support system comprising:

a track (6) provided with sawtooth racks (8);

a support device (7) that can be moved along the track, with a bottom plate (13);

a support back (15) projecting upward from the bottom plate (13);

locking means for engaging with the sawtooth rack (8) in the track when a backward-directed force is applied to the support back, the locking means projecting from the support device, wherein the track (6) is stationary, the bottom plate (13) of the support device (7) forms a supporting surface for goods and a movement of the bottom plate toward a front edge of a shelf is guided by the track as the bottom plate moves relative to the sawtooth rack (8) in the track; and an elongated operating tool (10) disposed under the bottom plate (13) of the support device (7) and in a recess in the track (6), the operating tool capable of begin at least partially pulled out from the recess in the track (6), wherein the operating tool has means for interacting with the support device (7) when the operating tool (10) is pulled out.

2. The support system claimed in claim 1, wherein the means for interacting is provided with two lugs (11, 12) which project upward for raising and bringing forward the bottom plate (13) of the support device, one of the two lugs being arranged to interact with a rear part of the bottom plate (13) and the other of the two lugs being arranged to interact with a part (17) projecting downward from a front part of the bottom plate (13).

3. The support system claimed in claim 2, wherein one of the lugs (12) is a dogging means.

4. The support system claimed in claim 2, wherein the distance between the lugs (11, 12) is the same as the distance between the back and front parts of the bottom plate (13) to facilitate a simultaneous raising of the whole bottom plate.

5. The support system claimed in claim 2, wherein a front one (11) of the lugs is provided with a forward-sloping inclined surface for interaction with a part (17) projecting downward from the front part of the bottom plate (13).

6. The support system claimed in claim 2, wherein a rear one (12) of the lugs engages with at least one part projecting downward from the back part of the bottom plate (13) to move the support device (7) forward, after the back part of the bottom plate has been raised.

7. The support system claimed in claim 2, wherein the lug (12) interacting with the back part of the bottom plate (13) interacts with a rounded-off part of the bottom plate to raise the bottom plate up.

8. The support system as claimed in claim 2, wherein the rear one (12) of the lugs is disposed at a back edge of the operating tool (10).

9. The support system as claimed in claim 1, wherein the locking means is backward-projecting elements (16) which interact with the sawtooth racks (8).

10. The support system as claimed in claim 1, wherein the operating tool is essentially the same length as the track.

11. The support system as claimed in claim 1, wherein the operating tool has a length such that the operating tool does not significantly protrude from a front end of the track when the operating tool is fully inserted into the recess.

* * * * *